United States Patent [19]

Craig

[11] 4,305,528

[45] Dec. 15, 1981

[54] CAP AND TUBE ASSEMBLY FOR A DISPENSING DEVICE

[76] Inventor: Clark E. Craig, 3260 Ironwood Ave., Rockford, Ill. 61109

[21] Appl. No.: 142,789

[22] Filed: Apr. 22, 1980

Related U.S. Application Data

[63] Continuation-in-part of Ser. No. 118,877, Feb. 6, 1980, abandoned.

[51] Int. Cl.[3] ..... B65D 83/14

[52] U.S. Cl. ..... 222/182; 222/530

[58] Field of Search ..... 222/182, 74, 527, 530, 222/402.13, 566, 528, 529, 517, 505, 394, 536, 538, 526, 537, 533; 239/588

[56] References Cited

U.S. PATENT DOCUMENTS

| | | | |
|---|---|---|---|
| 2,908,446 | 10/1959 | Strouse | 239/573 |
| 2,968,441 | 1/1961 | Holcomb | 239/337 |
| 3,178,070 | 4/1965 | Leland | 222/537 X |
| 3,216,628 | 11/1965 | Fergusson | 222/394 |
| 3,221,950 | 12/1965 | O'Donnell | 222/394 |
| 3,472,457 | 10/1969 | McAvoy | 239/337 |
| 3,476,111 | 11/1969 | Matheson | 128/227 |
| 3,980,210 | 9/1976 | Kligerman | 222/456 |
| 4,096,974 | 6/1978 | Haber et al. | 222/402.13 |

FOREIGN PATENT DOCUMENTS

| | | | |
|---|---|---|---|
| 1144385 | 3/1969 | United Kingdom | 222/527 |

*Primary Examiner*—Stanley H. Tollberg

*Attorney, Agent, or Firm*—Beveridge, DeGrandi, Kline & Lunsford

[57] ABSTRACT

A dispensing device is provided with a tube that engages a nozzle orifice of the device. During storage, a cap covers the orifice and defines an opening that is adjacent to the body of said device, such that the tube is able to extend beyond the periphery of the cap. The disposition of the cap relative to the tube and dispenser body causes the tube to lie in proximity to an external wall of the body. When the cap is removed or, in an alternative embodiment, rotated, the tube can assume a radially outward configuration.

32 Claims, 13 Drawing Figures

FIG. 1
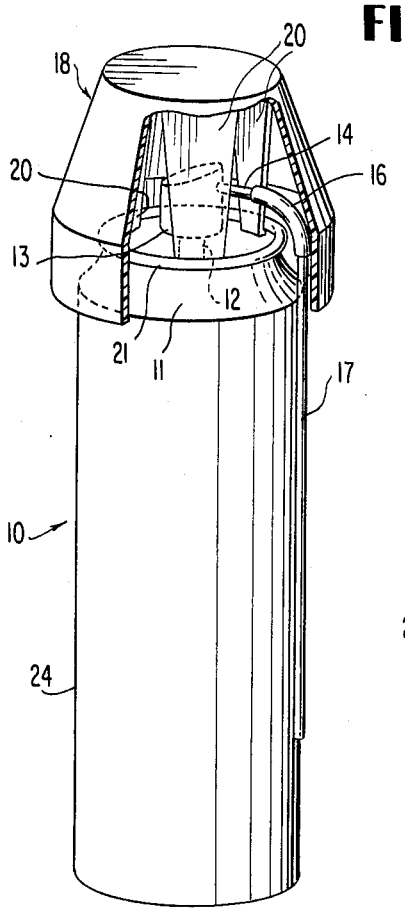
FIG. 2
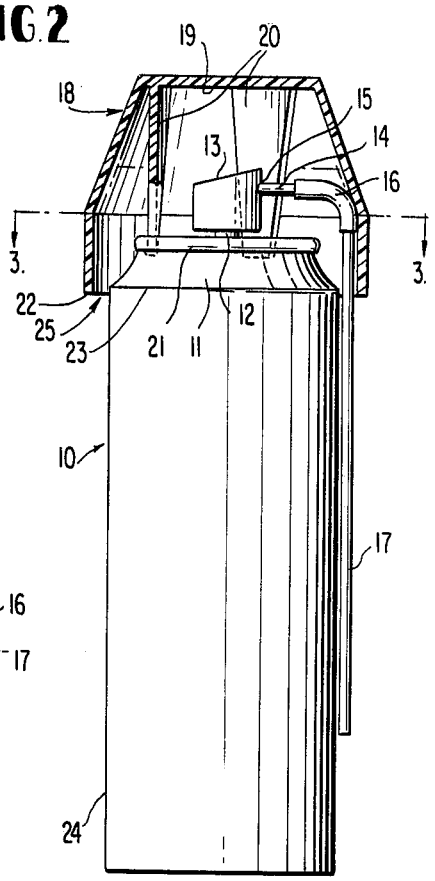
FIG. 3
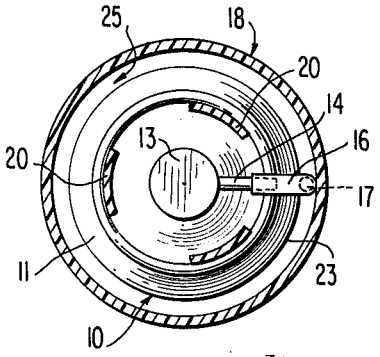
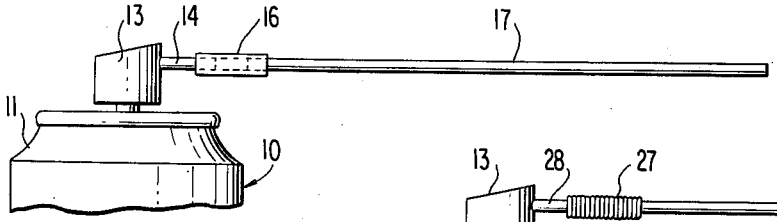
FIG. 4
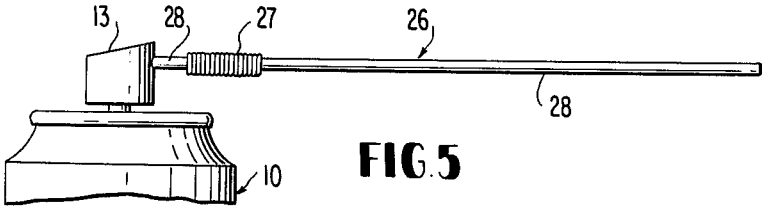
FIG. 5
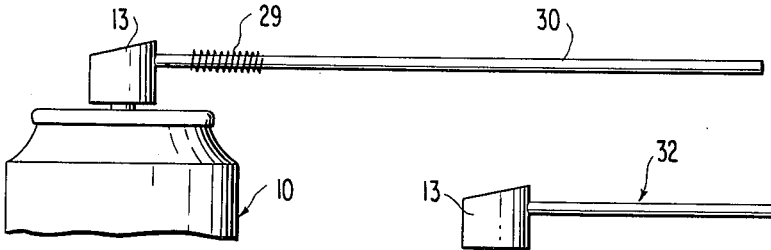
FIG. 6
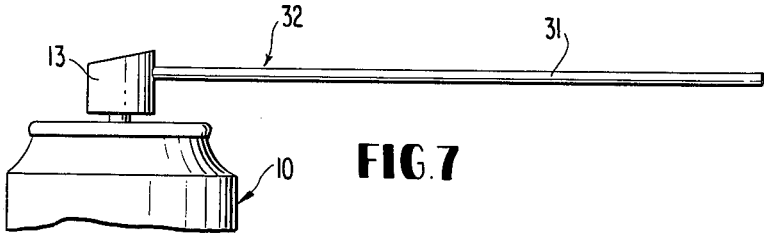
FIG. 7

CAP AND TUBE ASSEMBLY FOR A DISPENSING DEVICE

CROSS REFERENCES TO RELATED APPLICATIONS

This application is a continuation-in-part of copending application Ser. No. 118,877, filed Feb. 6, 1980, now abandoned, the entire disclosure of which is hereby relied upon and incorporated by reference.

BACKGROUND OF THE INVENTION

1. Field of the Invention

The present invention relates to an improved cap and tube assembly adapted to be used in conjunction with a dispensing device.

2. Description of the Prior Art

If is often advantageous to attach a tubular member to the ejection orifice of a dispensing device in order to deliver a fluid material a distance away from the orifice. In conventional dispensing devices having provisions for such tubes, it is common to provide a tube that is repeatedly engaged with and disengaged from the orifice and that is held adjacent to a surface of the body of the dispensing device with tape or a rubber band when disengaged.

The conventional arrangement has proven unsatisfactory for a number of reasons. To use the tube, it must be detached from the holding means and pressed into engagement with the orifice. To conveniently store the dispensing device, the tube must then be removed from the orifice and reattached to the surface of the dispensing body. Also, to secure the cap to the dispenser body to thus be availed of the safety and convenience features of the cap, it is essential that the tube be disengaged and reattached. In addition to the inconvenience of this system, a substantial possibility exists that the tube will be lost if it is not carefully reattached to the dispenser body. In view of these earlier deficiencies, and for other reasons that will become apparent upon a reading of the following description, the present invention represents a significant improvement over the devices of the prior art.

U.S. Pat. No. 3,980,210, issued Sept. 14, 1976 to Kligerman, discloses a tube and cap arrangement in a gravity activated granular material dispenser. A portion of the tube, in its natural configuration, extends perpendicularly from one end of a cylindrical container, and can be deformed into a horizontal position adjacent to the end and within the periphery of a cup-shaped cap. The length of the portion of the extended tube is restricted to the diameter of the cap, however, and fluid flow control is only possible in a uniform increment, dispensation of each such increment being possible only by the inconvenience of tilting the entire dispenser. Further, the continuation of the tube within the body of the dispenser container, and the natural disposition of the tube in a direction perpendicular to the surface of the end, are arrangements that are unsuitable for use in various types of commonly used fluid dispensers in which a fluid is directed outwardly from an orifice in a direction that is substantially parallel to a surface from which a supply conduit extends. Additionally, the Kligerman device requires the cap to be replaced in a peculiar fashion, i.e., from a particular direction that will cause the extended portion of the tube to bend toward the center of the surface of the dispenser end. Failure to replace the cap in such fashion will result in a resistance from and possible deformation of the portion of the tube that is extended.

U.S. Pat. No. 3,476,111 issued Sept. 4, 1969 to Matheson, discloses a disposable syringe that is intended for a single enema administration or single vaginal douche. The dispensation of fluid material from the syringe is effected by gravitational force. The material flows downwardly through a distensible conduit and elongated nozzle that are in communication with the interior of a material container. The syring can be vended in a package which holds the conduit and nozzle in contact with a side of the container. However, as noted, the device is designed for a single application only. In use, the conduit can extend to a length of about 16 inches and is preferably inelastic. No provision is made for the replacement of the device after use in the package in a fashion similar to the fashion in which it is originally vended. Further, the arrangement is unsuitable for use in the various types of commonly used fluid dispensers described in the previous paragraph, and the only flow control means provided is the pinching of the conduit. Continued interruption of the flow thus requires the inconvenience of continued pinching.

Thus, there exists a need in the dispensing art for a convenient dispensing device that is provided with a tube that can be attached to a nozzle orifice of the device at the same time that a cap is secured to the body of the device. Preferably, this dispensing device could be promptly, safely, and conveniently stored after use and promptly and conveniently used after storage, and the tube could have a length greater than the diameter of the cap.

SUMMARY OF THE INVENTION

Accordingly, this invention aids in fulfilling these needs in the art by providing a dispensing device that comprises a fluid container and an ejection orifice in communication with the container. An applicator tube engages the orifice and is able to be deformed angularly or arcuately when a cap is secured to the body of the dispenser. During storage, the cap covers the orifice and defines an opening that is adjacent to the body of the device, such that the tube is able to extend beyond the periphery of the cap. The disposition of the cap relative to the tube and dispenser body causes the tube to lie in proximity to the wall of the body. When the cap is removed or, in an alternative embodiment, rotated, the tube can assume a radially outward configuration.

BRIEF DESCRIPTION OF THE DRAWINGS

FIG. 1 is a top perspective view, showing a dispensing device equipped with one embodiment of the improved cap and tube assembly of the present invention, with the cap partly broken away for clarity of understanding.

FIG. 2 is an elevational view of the device depicted in FIG. 1, with the cap partly broken away for clarity of understanding.

FIG. 3 is a sectional plan view of the device depicted in FIG. 1 taken along line 3—3.

FIG. 4 is a fragmentary elevational view of the device depicted in FIG. 1 in which the cap has been removed and the tube extended for use.

FIGS. 5 through 7 and 11 through 13 are fragmentary views of dispensing devices equipped with modified tubes in accord with the present invention. In FIGS. 11 through 13, a suffix "a" refers to an elevational view and a suffix "b" refers to an end view.

Figure 8A:
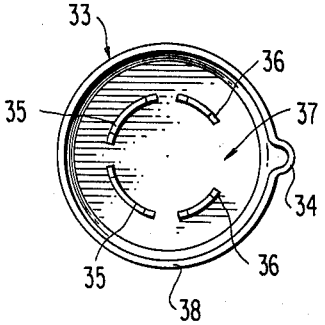
Figure 8B:
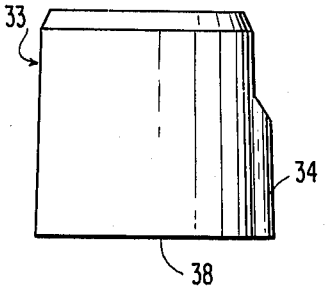
Figure 8C:
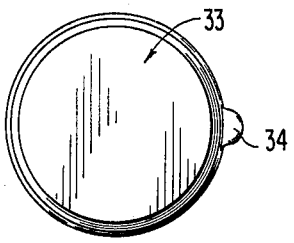
Figure 9A:
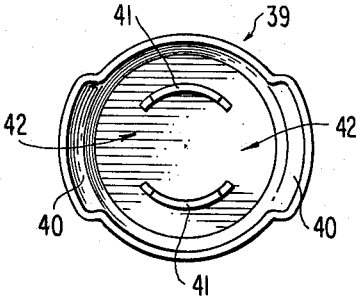
Figure 9B:
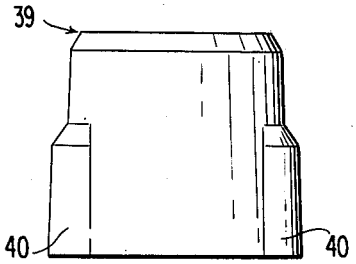
Figure 9C:
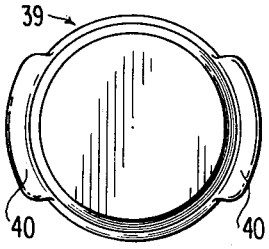
Figure 10A:
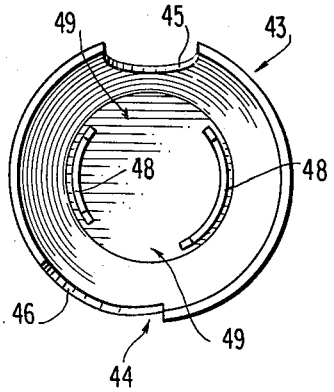
Figure 10B:
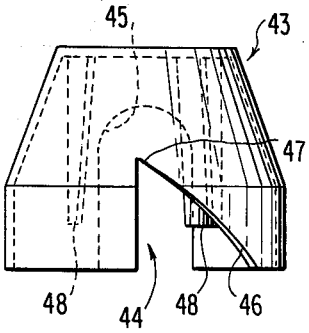
Figure 10C:
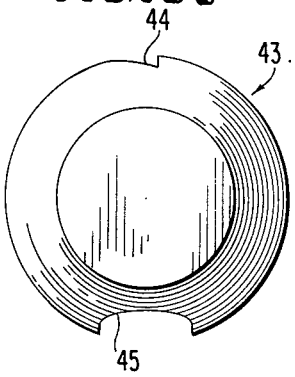

FIGS. 8 through 10 are views of different embodiments of caps in accord with the present invention, in which a suffix "a" refers to a bottom view, a suffix "b" refers to a side view, and a suffix "c" refers to a top view.

DESCRIPTION OF THE PREFERRED EMBODIMENT

Referring now more particularly to the drawings, a generally cylindrical fluid material container 10 is provided with a collar 11, supply conduit 12, and actuating nozzle 13. One end of a short section of tubing 14 is releasably held in nozzle orifice 15. Elastic sleeve 16 holds the other end of section 14 and one end of a long section of tubing 17. A space is preferably provided between the two ends held by sleeve 16.

Cap 18 is formed generally in the shape of an inverted cup. Tapered support members 20 extend downwardly from the inner surface 19 of the top of cap 18 to releasably engage retaining ring 21 and thus releasably hold cap 18 in position on top of container 10. When in position, open end 22 of cap 18 extends downwardly past the uppermost edge 23 of container wall 24 and has an internal diameter larger than the external diameter of edge 23, to thus define an annular space 25 between the sections of cap 18 and wall 24 that overlap. Space 25 is adapted to receive tubular section 17 such that when cap 18 is in position on top of container 10, sleeve 16 is deformed in a downward arc or angle, and section 17 is caused to be disposed in proximity to wall 24, as depicted in FIGS. 1 and 2.

Sleeve 16 can be composed of any suitable material that will allow angular movements of tubular sections 14 and 17 relative to each other. Tubular sections 14 and 17 can be composed of any suitable material that will impart a rigid or semi-rigid quality to the sections, such that the deformability of the section is less than that of the sleeve.

Preferably, sleeve 16 will possess an elasticity tending to restore sections 14 and 17 to a substantially linear relationship after a deforming force is removed. FIG. 4 is a fragmentary view of the dispensing device of FIG. 2 in which the cap has been removed and the sleeve 16 has restored sections 14 and 17 to a linear relationship.

It is important that it be understood that while the various embodiments of applicator tubes coming within the scope of this invention will preferably assume a substantially linear configuration upon removal of a deforming force, the invention also includes a tube in which any degree of restoration of linear configuration is caused by the elasticity of the tube, including no degree of restoration in which a tube will remain in a deformed position after the deforming force is removed.

In another embodiment of the present invention, depicted in FIG. 5, the sleeve 16 and sections of tubing 14 and 17 of FIGS. 1 and 2 are replaced by partially pleated tube 26. Tube 26 comprises a pleated section 27 which allows angular movement of the two non-pleated sections 28 relative to each other.

Preferably, pleated section 27 will also possess an elasticity tending to decrease the degree of deformation of tube 26 following removal of a deforming force. Non-pleated sections 28 are rigid or semi-rigid such that their deformability is less than that of pleated section 27.

Tube 26 can be composed of any suitable material that is capable of being shaped in a pleated section having the necessary characteristic of deformability. The pleating of the material can be effected by any of several manufacturing processes, including blow-molding or exerting of a longitudinally compressive force in a section of tubing during the production thereof. It is also within the scope of this invention to form tube 26 by means of an intermittent extrusion of two materials wherein one material would be more suitable for the formation of sections 28 and the other material would be more suitable for the formation of section 27.

In another embodiment of the present invention, depicted in FIG. 6, the sleeve 16 and sections of tubing 14 and 17 of FIGS. 1 and 2 are replaced by spring 29 and a tube 30. The spring is disposed around tube 30 along a section of the tube that includes at least one point at which the tube can be arcuately or angularly deformed. The spring should be of linear configuration in its natural condition but must be capable of readily assuming an arcuate or angular form when a deforming force is applied. When the force is removed, it is preferred that the spring will tend to regain its natural shape. Tube 30 can be composed of any suitable material that will impart rigidity or semi-rigidity to the tube, but that will allow the tube to be readily deformed angularly or arcuately at at least one point without being severed or split. Tube 30 can also be composed of two materials, intermittently extruded, whereby one of the materials would be better suited for providing the point or points of deformation. The internal diameter of spring 29 is preferably only slightly larger than the external diameter of tube 30, and the spring is maintained in proximity to a section of tube 30 by any suitable means, including a mechanical frictional, or adhesive retentive force.

In another embodiment of the present invention, depicted in FIG. 7, the sleeve 16 and sections of tubing 14 and 17 of FIGS. 1 and 2 are replaced by a deformable tube 31 which may be of substantially uniform deformable and preferably elastic characteristics throughout its length or which may comprise a modified section, generally indicated by reference numeral 32. When tube 31 is of substantially uniform characteristics, it can be composed of any material that will cause the tube to be capable of arcuate or angular deformation without being severed or split. When tube 31 comprises a modified section, the increased deformability of that section can be provided by a number of methods, including increasing the internal diameter of the tube at that section and/or decreasing the external diameter of the tube at that section. Additionally, the deformability of the modified section can be provided by intermittent extrusion of two types of materials to form the tube whereby the modified section is composed of a material that imparts enhanced deformability characteristics. The sections of tube 31 that are not modified should be rigid or semi-rigid such that they are less deformable than modified section 32. It is preferred that modified section 32, by whatever means provided, will additionally possess an elasticity tending to reduce the degree of deformation of tube 31 after a deforming force is removed.

Figure 11A:
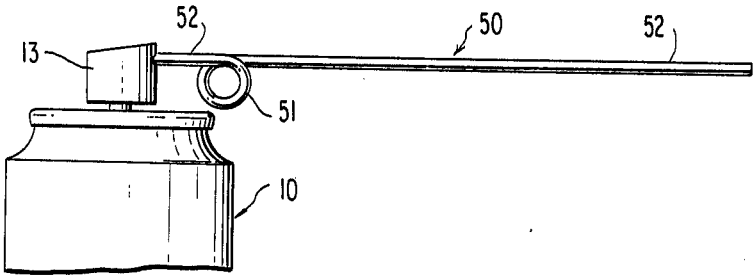
Figure 11B:
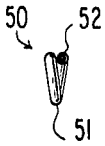
Figure 12A:
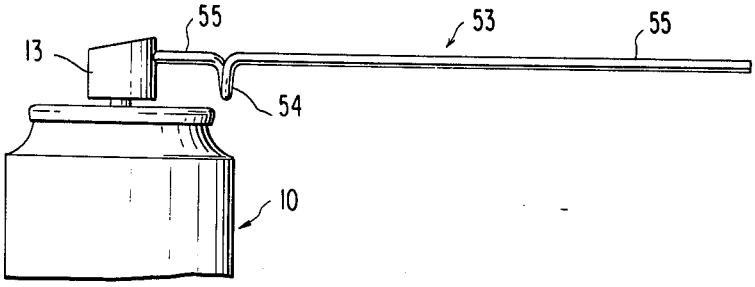
Figure 12B:
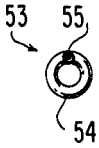
Figure 13A:
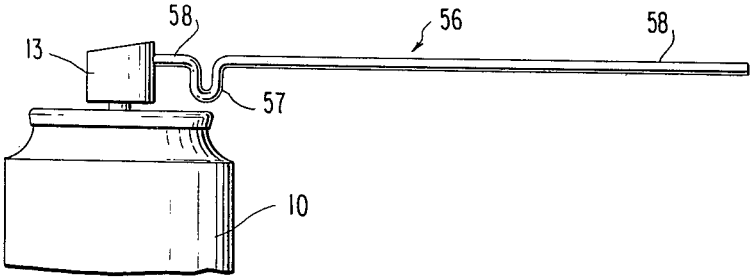
Figure 13B:
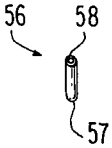

A modified section having the necessary characteristics of deformability, as described hereinabove, can also be supplied by providing one or more looped or U-shaped sections in an applicator tube. FIGS. 11 through 13 depict possible configurations of modified sections supplied in this fashion. Tubes 50, 53 and 56 replace sleeve 16 and sections of tubing 14 and 17, as depicted in FIGS. 1 and 2.

Tube 50, depicted in FIG. 11, comprises a looped section 51 which allows angular movement of the two non-looped sections 52 relative to each other. The plane in which looped section 51 lies is substantially parallel to the length of tube 50.

Tube 53, depicted in FIG. 12, comprises a looped section 54, which allows angular movement of the two non-looped sections 55 relative to each other. Tube 53 differs from tube 50 in that the plane in which looped section 54 lies is substantially perpendicular to the length of tube 53.

Tube 56, depicted in FIG. 13, comprises a U-shaped section 57, which allows angular movement of the two sections 58 relative to each other.

While specific embodiments of modified sections have been depicted in FIGS. 11 through 13, it should be understood that such sections can be supplied, in accord with the present invention, in any fashion in which a relatively linear section of an applicator tube is interrupted by a relatively non-linear section that is capable of allowing angular movement of two rigid or semi-rigid sections of tubing relative to each other. Accordingly, the scope of the present invention includes modified sections comprising multiply looped or multiply U-shaped sections; looped or U-shaped sections oriented in any direction relative to the length of the applicator tube; other shapes that provide a deviation from a relative linearity of an applicator tube, including irregular shapes; and any combination of the foregoing shapes, such that such modified sections allow the angular movement of the rigid or semi-rigid sections of tubing relative to each other.

The composition of modified sections 51, 54 and 57 can be the same as the composition of sections 52, 55 and 58, respectively, provided that the material of which the modified sections are composed will allow deformability without causing cracking or splitting of the tube. The modified section can also be characterized as being comprised of tubing having altered interior and/or exterior diameters, and can be produced by an intermittent extrusion of a material that imparts enhanced deformability characteristics to the modified section. The sections of tubing 52, 55 and 58 should be rigid or semi-rigid such that they are less deformable than modified sections 51, 54 and 57, respectively. It is preferred that modified sections 51, 54 and 57, and other types of modified sections that provide a deviation from a relative linearity of the applicator tube, will additionally possess an elasticity tending to reduce a degree of deformation of a respective applicator tube after a deforming force is removed.

While the applicator tubes described hereinabove possess substantially constant diameters throughout their length, it should be understood that the term applicator tube is intended to broadly describe a variety of possible configurations, including flanged, multiple opening, or non-linear configurations. Any member that is capable of delivering the dispensed material a distance from a dispenser orifice is intended to be within the scope of the term.

Suitable materials for the applicator tubes described hereinabove include plastics, metals, and cellulosic derivatives. Typical plastics include polyethylene or polystyrene. Preferably, the applicator tubes will be clear and disengageable from orifice 15 in order to facilitate internal inspection and cleaning. The disengageability from orifice 15 also permits the dispensed material to be applied in a wide angle if desired, by disengagement of the applicator tube.

If the applicator tube is not disengageable, the connection of the tube to the orifice can be made by any suitable adhesive, frictional, or mechanical means. Alternatively, the applicator tube and nozzle 13 and/or conduit 12 can be of unitary construction.

It is within the scope of the present invention to provide that the ejection orifice be defined by a surface of the fluid container, wherein actuating nozzle 13 and supply conduit 12 would be eliminated. In this embodiment, the applicator tube can be connected to the orifice in a disengageable or non-disengageable fashion by any suitable adhesive, frictional, or mechanical means, or by constructing the tube and fluid container in a unitary fashion.

It is also within the scope of the present invention that the various sections of tubing described hereinabove, that provide for arcuate or angular deformation of the tube, communicate directly with the nozzle orifice. In this fashion, a small section of rigid or semi-rigid tubing is eliminated and a large section of rigid or semi-rigid tubing is allowed to move in an arc, for example, from a substantially perpendicular position to a substantially parallel position, relative to a wall or central axis of a container.

In a further embodiment of the present invention, depicted in FIG. 8, a cap 33 is provided with channel 34. The external diameter of cap 33 at its open end is approximately the same as the external diameter of the uppermost edge 23 of wall 24. An annular arrangement of support members 35, having tapered segments 36, releasably engage retaining ring 21 and define an opening 37 that is in radial alignment with channel 34. When cap 33 is placed in position on top of container 10, the edge 38 rests on top of uppermost edge 23. Channel 34 is adapted to receive an applicator tube of the present invention.

In a further embodiment of the present invention, depicted in FIG. 9, cap 39 is provided with two opposing wide channels 40 and tapered support members 41. Members 41 define openings 42 which are in radial alignment with channels 40. Cap 39 rests upon uppermost edge 23 in a similar fashion as does cap 33, and wide channels 40 are adapted to receive an applicator tube of the present invention.

In a still further embodiment of the present invention, depicted in FIG. 10, cap 43 is formed generally in the shape of a cup having dimensions substantially similar to that of cap 18. Cap 43, however, is provided with a slot 44 and access opening 45. Slot 44 has a sloping edge 46 and a section 47, which is adapted to receive an extended applicator tube of the present invention, exemplified by partially pleated tube 26 as depicted in FIG. 5. Support members 48 are provided and define openings 49, which are in radial alignment with slot 44 and access opening 45. It is also contemplated as being within the scope of the present invention to provide a guide member to be affixed to a section of collar 11 in close proximity to the applicator tube and disposed within a section defined by cap 43 when the cap is engaged with retaining ring 21, the purpose of such member being to tend to restrict the operative movement of an applicator tube to a single vertical plane. Finally, it is to be understood that support members 48 can be fixedly attached to retaining ring 21, provided that cap 43 is capable of axial rotation.

Suitable materials for the caps described hereinabove include metals, plastics and cellulosic derivatives. Typical plastics include polystyrene and acrilonitrile-butadiene-styrene copolymers. Although cap 18 has been illustrated and described in conjunction with only one embodiment of an applicator tube, it should be understood that the use of all of the caps of the present invention is possible with any of the applicator tubes of the present invention.

The support members of the various caps described hereinabove can engage the retaining ring 21 by any suitable means, which can include protruding tabs disposed at the lower tips of the members, pressure exerted outwardly by the members against the ring, and/or gravity. It is also contemplated that the support members can be eliminated completely and that a suitable means can be provided for engaging the open end of the outer wall of the cap with the dispenser body.

The dispensing device of the present invention can be used for the dispensation of any fluid material that is capable of being carried through an applicator tube. Typical fluids include oils and paints. When dispensation of a contained fluid is desired, caps 18, 33, and 39 are disengaged from the dispenser body. The applicator tube will then rise to a desired position, either due to its inherent resiliency or a manual lifting of the tube. During use, the applicator tube can be disposed in any suitable outward position relative to the wall of dispenser body 10, which is not limited to the 90 degree position depicted in FIGS. 4 through 7 and 11 through 13. When caps 18, 33 and 39 are replaced on top of the dispenser body, the applicator tube is deformed downwardly such that a portion of the tube is in proximity with wall 24.

Cap 43 is used by axially rotating the cap about nozzle orifice 15. When slot 44 is in radial alignment with the orifice, an applicator tube will be allowed to rise a distance that is related to the height of the slot at the point of radial alignment with the orifice. When section 47 is in radial alignment with the orifice, the tube is allowed to assume a perpendicular direction relative to wall 24. Access opening 45 provides access to actuating nozzle 13. When it is desired to store the device, the cap is simply rotated so that sloping edge 46 assists in deforming the tube downwardly such that a portion of the tube is in proximity with wall 24. It is not essential that sloping edge 46 assist in the deformation nor that it even be provided in this embodiment, however, it being understood that deformation can be manually induced, followed by a rotation of cap 43 to retain the tube in its deformed configuration.

When the fluid is propelled by the internal pressure of the container, such pressure can be produced by any suitable propellant fluid, including fluorinated hydrocarbons, such as Freon. The fluid can also be propelled by a pump-type dispensing means, a compressible container-type dispensing means or any other suitable means, including gravity.

It is understood that the detailed illustrations, descriptions and examples hereinabove presented are not intended to limit the scope of the present invention in any way, and that changes and modifications may be made which would be within the spirit of the invention and within the scope of the following claims. For example, it is readily apparent that an opening between the container and cap 33, such as that provided by channel 34, could as easily be provided by a channel disposed within wall 34.

I claim:

1. A dispensing device comprising a fluid container;

an ejection orifice in communication with said container;

an applicator tube engaged with said orifice, said tube comprising at least one point that will permit an angular or arcuate deformation of said tube; and a cap releasably engaged with said container to thus cover said orifice, said cap defining at least one opening between a wall of said container and said cap, said opening being adapted to receive said tube; such that said at least one point is within the periphery of said cap and the disposition of said cap relative to said wall and said tube causes the tube to be deformed so that a portion of said tube is disposed in proximity to said wall.

2. A dispensing device as described in claim 1 wherein a supply conduit communicates with said container at one end of said conduit and with said orifice at another end of said conduit, and wherein said orifice dispenses a fluid in a radially outward direction from said orifice.

3. A dispensing device as described in claim 1 wherein said applicator tube possesses an elasticity tending to reduce a degree of angular or arcuate deformation of said tube when said cap is disengaged from said container.

4. A dispensing device as described in claim 1 wherein said tube comprises a deformable sleeve and at least one rigid or semi-rigid tubular section, wherein said sleeve comprises said at least one point.

5. A dispensing device as described in claim 1 wherein said tube comprises a pleated section of tubing that in turn comprises said at least one point.

6. A dispensing device as described in claim 1 wherein said tube comprises a spring and a length of tubing, wherein said spring is annularly disposed in relation to a section of said length that comprises said at least one point.

7. A dispensing device as described in claim 1 wherein said tube comprises at least one rigid or semi-rigid section and a modified section which in turn comprises a wall portion having reduced thickness relative to said at least one rigid or semi-rigid section, said wall portion comprising said at least one point.

8. A dispensing device as described in claim 1 wherein said tube comprises at least one rigid or semi-rigid section and a modified section, said modified section being composed of a material that provides greater deformability relative to a second material composing said at least one rigid or semi-rigid section, such modified section comprising said at least one point.

9. A dispensing device as described in claim 1 wherein said tube comprises a relatively non-linear section which comprises said at least one point.

10. A dispensing device as described in claim 9 wherein said non-linear section comprises at least one loop.

11. A dispensing device as described in claim 10 wherein said at least one loop is disposed in a plane that is substantially parallel to a length of the tube that is adjacent to said at least one loop.

12. A dispensing device as described in claim 10 wherein said at least one loop is disposed in a plane that is substantially perpendicular to a length of a tube is adjacent to said at least one loop.

13. A dispensing device as described in claim 9 wherein said non-linear section comprises at least one U-shaped section.

14. A dispensing device as described in claim 1 further comprising at least one support member extending from an inner surface of said cap, a retaining element disposed on a surface of said container, and a means for engaging said at least one member to said element, wherein said at least one opening is a continuous annular opening and said at least one member defines at least one space that may be disposed in radial alignment with said orifice.

15. A dispensing device as described in claim 1 further comprising at least one support member extending from an inner surface of said cap, a retaining element disposed on a surface of said container, and a means for engaging said at least one member to said element, wherein said opening is not substantially larger than said tube and said at least one member defines a space that is in radial alignment with said opening.

16. A dispensing device as described in claim 1 further comprising at least one support member extending from an inner surface of said cap, a retaining element disposed on a surface of said container, and a means for engaging said at least one member to said element, wherein said at least one opening is defined by a cross-sectional dimension that is substantially wider than the diameter of said tube and wherein said at least one member defines at least one space that is in radial alignment with said at least one opening.

17. A dispensing device comprising a fluid container;

an ejection orifice in communication with said container;

an applicator tube engaged to said orifice, said tube comprising at least one point that will permit an angular or arcuate deformation of said tube; and a cap rotatably engaged with said container to thus cover said orifice, said cap defining (a) an opening between a wall of said container and said cap, said opening being adapted to receive said tube when said tube is in a deformed configuration, (b) a vertical slot adjacent to said opening, said slot being adapted to receive said tube when said tube is in a radially outward configuration, and (c) an access opening, said access opening being disposed adjacent to an open end of said cap; such that said at least one point is within the periphery of said cap and the disposition of said cap relative to said wall and said tube allows said tube to attain said outward configuration when said slot is in radial alignment with said orifice and causes the tube to assume said deformed configuration when said slot is not in radial alignment with said orifice, a portion of said tube being disposed in proximity to said wall when said tube is in said deformed configuration.

18. A dispensing device as described in claim 17 wherein a supply conduit communicates with said container at one end of said conduit and with said orifice at another end of said conduit, and wherein said orifice dispenses a fluid in a radially outward direction from said orifice.

19. A dispensing device as described in claim 17 wherein said applicator tube possesses an elasticity tending to reduce a degree of angular or arcuate deformation when said slot is in radial alignment with said orifice.

20. A dispensing device as described in claim 17 further comprising at least two support members extending from an inner surface of said cap, a retaining element disposed on a surface of said container, and a means for engaging said members to said element, wherein said members define spaces that are in radial alignment with at least a portion of said opening, said slot, and said access opening, said portion of said opening being adjacent to said slot.

21. A dispensing device as described in claim 17 wherein said slot is defined by at least one sloping edge that is adjacent to said open end of said cap.

22. A dispensing device as described in claim 21 further comprising a guide member affixed to a surface of said container such that said guide member is in close proximity to a portion of said applicator tube that is within the periphery of said cap, said guide member defining a path for said tube between said deformed configuration and said radially outward configuration.

23. A dispensing device as described in claims 1 or 17 further comprising a means to propel a fluid to be dispensed.

24. A dispensing device as described in claim 23 wherein said means to propel comprises a propellent fluid.

25. A dispensing device as described in claim 23 wherein said means to propel comprises a pump.

26. A dispensing device as described in claim 23 wherein said means to propel comprises at least one compressible internal surface within said container.

27. A dispensing device as described in claim 23 wherein said means to propel comprises a gravitational force.

28. A dispensing device as described in claims 1 or 17 wherein the engagement of said applicator tube to said orifice is a releasable engagement.

29. A dispensing device as described in claims 1 or 17 wherein the engagement of said applicator tube to said orifice is a fixed engagement.

30. A dispensing device as described in claims 1 or 17 wherein said applicator tube and said orifice are unitary.

31. A dispensing device as described in claims 1 or 17 wherein the engagement of said applicator tube to said orifice is provided by means of a unitary construction of said applicator tube and a member defining said orifice.

32. A dispensing device as described in claim 1 wherein said tube is of substantially uniform composition throughout its length.

* * * * *